US006520289B1

(12) United States Patent
Bo

(10) Patent No.: US 6,520,289 B1
(45) Date of Patent: Feb. 18, 2003

(54) INTAKE SILENCER FOR SEALED REFRIGERANT COMPRESSOR

(75) Inventor: Giuseppe Bo, Rivarolo Canavese (IT)

(73) Assignee: Embraco Europe S.r.l., Turin (IT)

( * ) Notice: Subject to any disclaimer, the term of this patent is extended or adjusted under 35 U.S.C. 154(b) by 0 days.

(21) Appl. No.: 09/914,154

(22) PCT Filed: Feb. 26, 1999

(86) PCT No.: PCT/EP99/01238

§ 371 (c)(1),
(2), (4) Date: Aug. 24, 2001

(87) PCT Pub. No.: WO00/52334

PCT Pub. Date: Sep. 8, 2000

(51) Int. Cl.[7] ..... F01N 1/02
(52) U.S. Cl. ..... 181/403; 181/229; 181/230
(58) Field of Search ..... 181/403, 404, 181/229, 230

(56) References Cited

U.S. PATENT DOCUMENTS

| | | | | |
|---|---|---|---|---|
| 3,125,182 A | * | 3/1964 | Earley | 181/265 |
| 4,109,751 A | * | 8/1978 | Kabele | 181/229 |
| 4,793,775 A | | 12/1988 | Peruzzi | |
| 5,749,714 A | * | 5/1998 | Lee | 181/403 |

FOREIGN PATENT DOCUMENTS

| | | |
|---|---|---|
| DE | 195 22 383 A1 | 1/1997 |
| FR | 2 746 861 A1 | 10/1997 |

OTHER PUBLICATIONS

Lampugnani et al.: Suction muffler design for noise reduction on high efficiency reciprocating compressors Proceedings of the 1990 International Compressor Engineering Conference at Purdue, vol. 2, Jul. 17–20, 1990, p. 590, XP002112447 West Lafayette, Indiana, USA.

* cited by examiner

*Primary Examiner*—Shih-Yung Hsieh
(74) *Attorney, Agent, or Firm*—Sughrue Mion, PLLC

(57) ABSTRACT

The hollow body of an intake silencer comprises a pair of matching insert (42,44) of rigid moulded plastics material which are confined in a lower-cup shaped element (28) by a lid (30) and which together have a T-shaped configuration with a longitudinal partition (46) which corresponds to the leg of the T and which extends in the lower element (28) dividing it into two juxtaposes resonance chambers (88, 90), and with a transverse partition (48-56) which corresponds to the transverse portion of the T and which separated the juxtaposed resonance chambers (88, 90) from an upper outlet chamber (96). Each insert (42, 44) comprises a respective upper flange (48, 56) corresponding to a respective half of the transverse partition. One of the inserts comprises the longitudinal partition (46) and this longitudinal partition has a siphon-shaped half-duct (52) in the form of a recess; the other insert (44) comprises at least one semi-tubuler appendage (54) of corresponding siphon-like shape, extending from the respective upper flange (56) and constituting another half-duct which, in combination with the aforesaid recess (52), completes the internal duct.

10 Claims, 4 Drawing Sheets

INTAKE SILENCER FOR SEALED REFRIGERANT COMPRESSOR

BACKGROUND OF THE INVENTION

The present invention relates to an intake silencer for sealed motor-driven compressors for refrigerators and the like, according to the preamble to claim 1.

An intake silencer according to the preamble to claim 1, which represents the closest prior art, is illustrated in the article ("Suction Muffler Design for Noise Reduction on High Efficiency Reciprocating Compressors", G. Lampugnani, F. Peruzzi, P. Way, in "Proceedings of the 1990 International Compressor Engineering Conference at Purdue", Volume 2, Jul. 17–20, 1990, West Lafayette, Ind., USA, p. 590, FIG. 6, Solution 3.

In this known silencer, the cavity of the lower element is divided by a transverse partition into two resonance chambers which are disposed one above the other and which behave like two impedances in series.

Its advantages in comparison with more conventional silencers are a small volume, good noise attenuation, and good compressor efficiency.

On the other hand, it has the disadvantage that it cannot be produced by a simple operation to assemble a few simple and inexpensive parts made of moulded plastics material.

SUMMARY OF THE INVENTION

The object of the present invention is to provide an intake silencer which has characteristics similar to those of the silencer according to the closest prior art, and which is suitable for this economically more advantageous assembly operation.

According to the invention, this object is achieved by means of an intake silencer as claimed.

As will be understood further from the description with reference to the drawings, by virtue of this concept, it is possible to produce an intake silencer from only four pieces of moulded plastics material, that is, the lower element, the upper element or lid, and the two inserts.

These parts are advantageously assembled by the following three successive steps:

coupling of the two inserts, introduction of the two coupled inserts into the lower element, snap-fitting of the lid on the lower element.

In implementing the invention, it has been found that the silencer claimed has a further gain in efficiency in comparison with the silencer according to the closest prior art. This gain in efficiency will be discussed at the end of this description.

The characteristics and advantages of the invention will become clearer from a reading of the following detailed description, given with reference to the appended drawings, provided by way of non-limiting example, in which:

DETAILED DESCRIPTION OF THE INVENTION

In order to explain the context in which the invention has been developed, some principal parts of a motor-driven compressor similar to that described and illustrated in the document IT-B-1 218 949, to which reference should be made for further details, will first of all be described with reference to FIG. 1.

Figure 1:
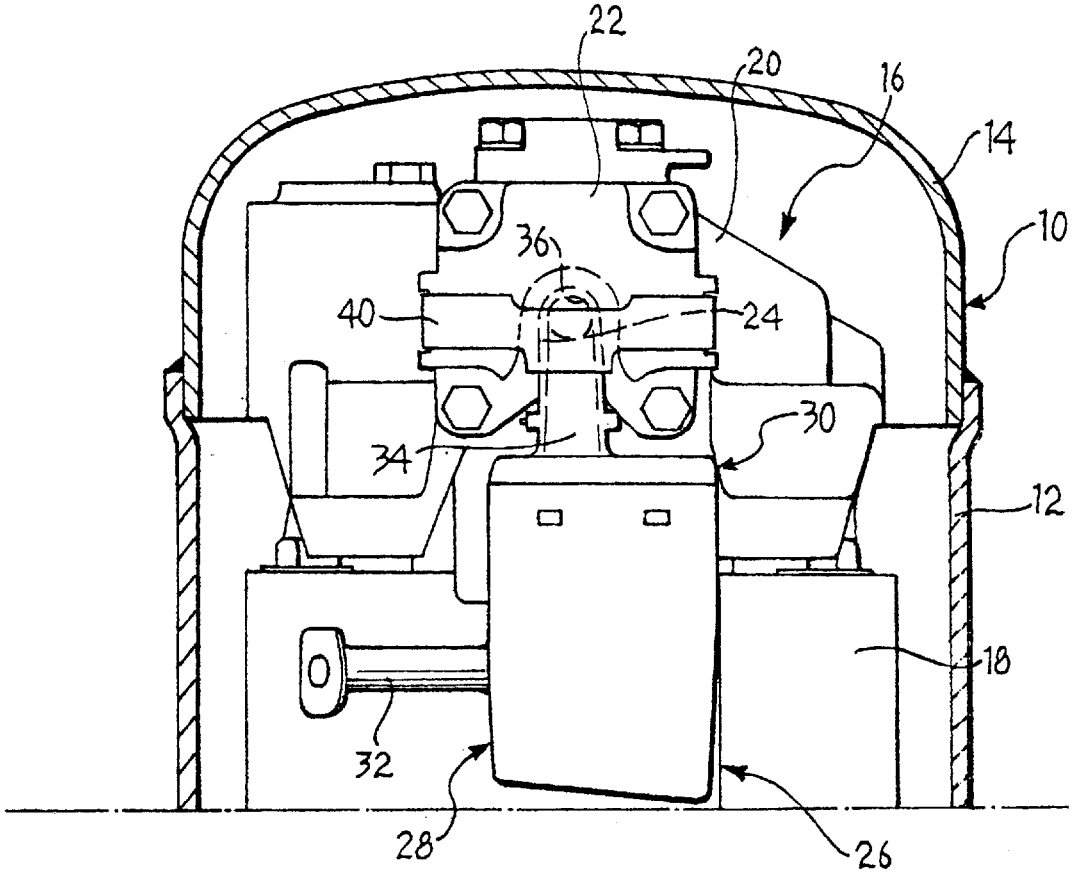
FIG. 1 is a partial section taken in a vertical plane, showing the internal details of a motor-driven compressor including an intake silencer according to the invention with its internal parts visible by transparency.
Figure 7:
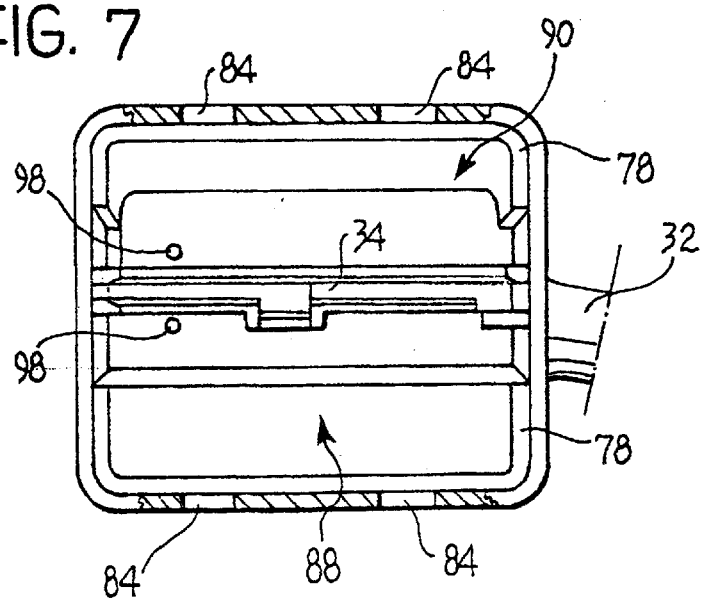
FIG. 7 is a section taken in the plane indicated VII—VII in FIG. 4.

With reference to FIG. 1, a motor-driven compressor comprises a sealed housing, generally indicated 10. The housing 10 is formed by two half-shells, that is, a lower half shell 12 and an upper half-shell 14.

The housing 10 accommodates a motor-driven compressor, generally indicated 16.

The compressor 16 comprises an electric motor of which the stator-plate assembly, indicated 18, is visible.

The casing 20 of a positive-displacement compressor is fixed to the upper portion of-the stator assembly 18.

The cylinder (rot shown) of the compressor has a head unit of which an output manifold head 22 forms part.

In the manifold head 22 there is a central space 24 which opens towards the exterior of the compressor as well as downwardly, that is, towards the stator assembly 18.

An intake of the head unit opens into the space 24.

An intake silencer according to the invention, generally indicated 26, is associated with the head unit and will now be described with particular reference to FIGS. 2 to 7, as well as, at times, to FIG. 1.

The silencer 26 comprises a hollow body made of plastics material and constituted by a lower element 28 in the form of a cup and an upper element 30 in the form of a lid.

The lower element 28 comprises an inlet duct 32 which extends laterally therefrom and is connected, in a manner not shown, for example, by means of a bellows, to the mouth of an intake pipe which comes from outside the sealed housing 10.

The upper element 30 comprises an upper hollow appendage 34 which constitutes an upper outlet duct.

As shown in FIG. 1, the appendage 34 is fitted in the central space 24 of the manifold head 22.

Towards its upper end, the appendage 34 has a lateral hole 36 for putting the upper outlet duct 34 into Communication with the intake (best visible in FIGS. 2 to 4 and 6) of the head unit of the positive-displacement compressor.

Figure 2:
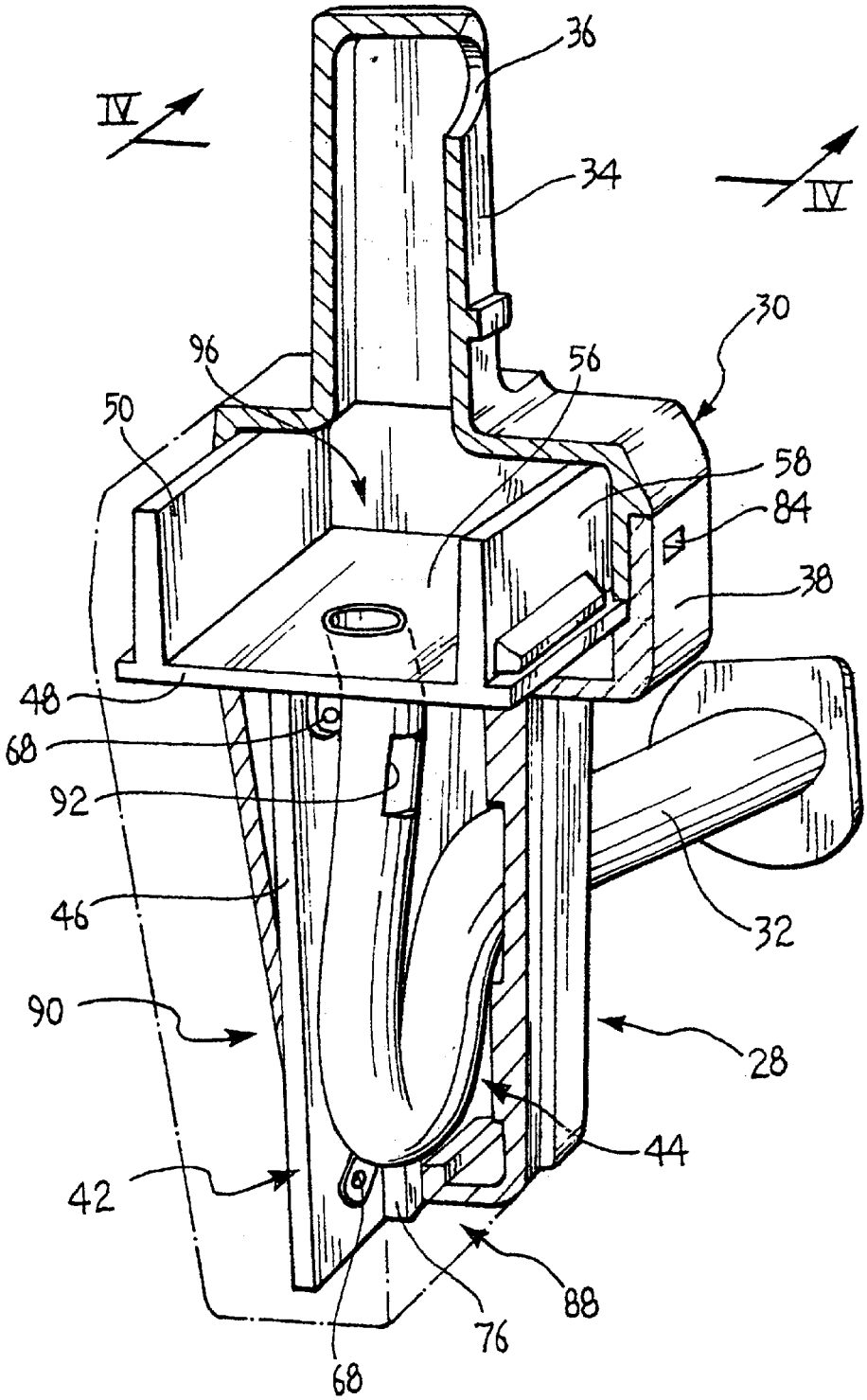
FIG. 2 is a vertically-sectioned, perspective view of the silencer.
Figure 3:
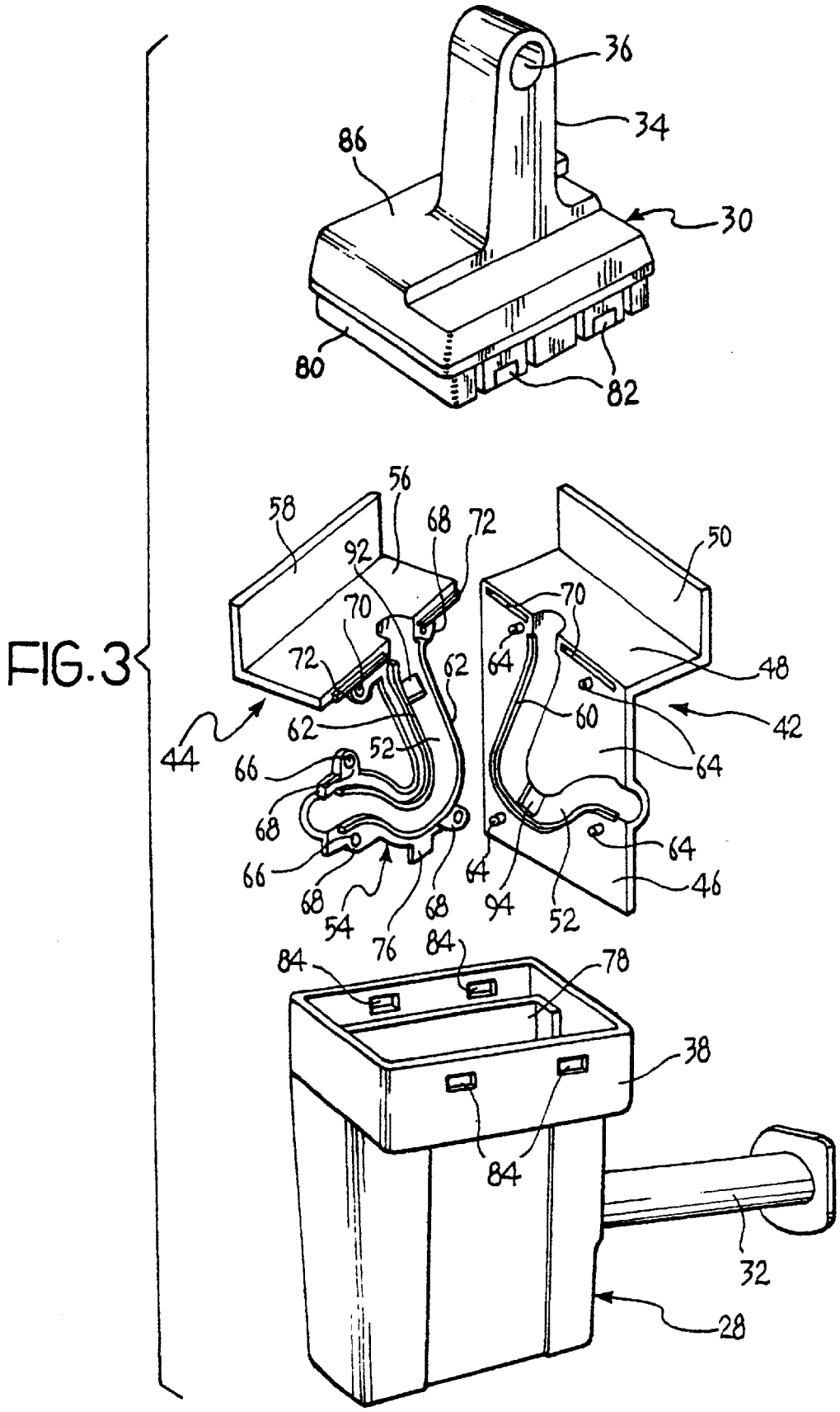
FIG. 3 is an exploded perspective view thereof.
Figure 6:
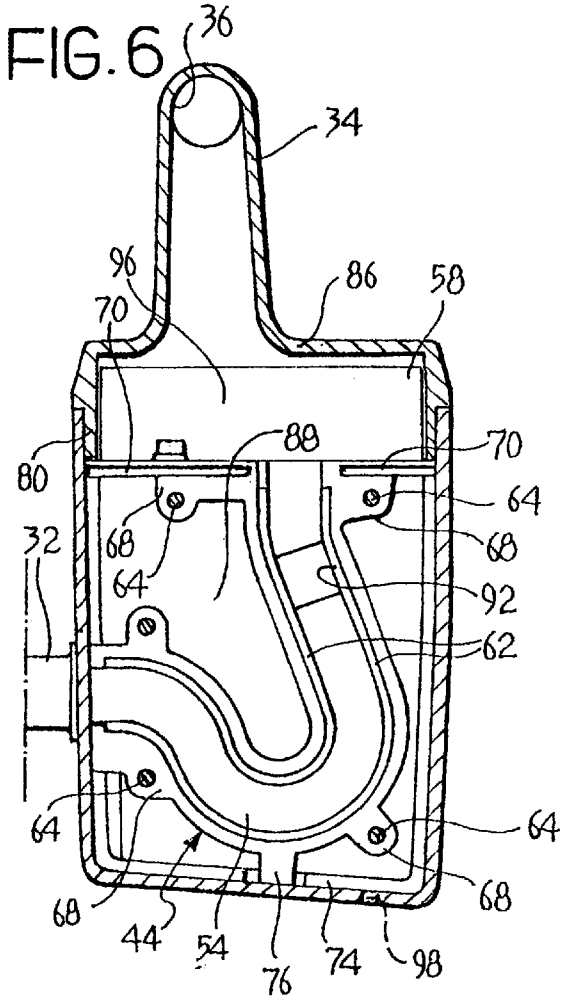
Figure 5:
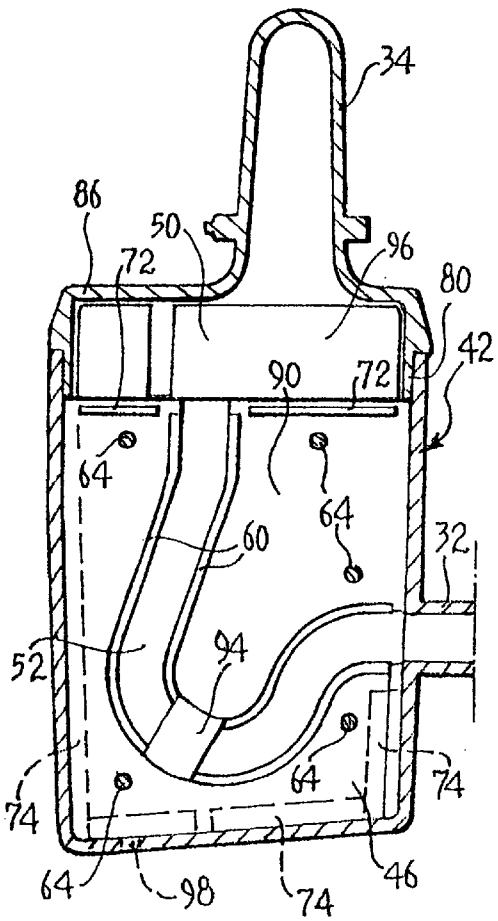
Figure 4:
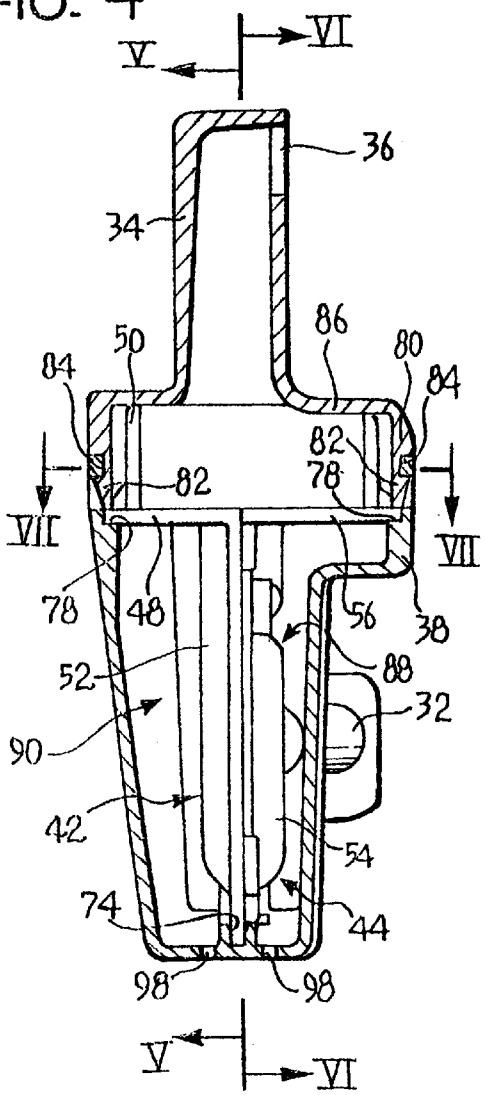
FIG. 4 is a section through the silencer, taken in the plane indicated IV—IV in FIG. 2, FIGS. 5 and 6 are sections taken in the planes indicated V and VI in FIG. 4, respectively.

As can be seen in FIGS. 2 to 4, the body of the silencer has a projecting portion 38 which is defined both by the lower element 28 and by the upper element 30 and which is fitted between the upper face of the stator assembly 18 and a corresponding lower edge of a flange to which the manifold head 22 is fixed.

The body of the silencer is restrained in this fixed position by a resilient clip 40 (FIG. 1) which extends around the manifold head 22 and a central portion of which holds the appendage 34 firmly in the space 24.

The lower element 28 of the body of the silencer 26 contains a pair of matching inserts of rigid moulded plastics material, generally indicated 42 and 44, respectively.

The insert 42 comprises a plate-like portion 46, an upper right-angled flange 48, and a lateral rim 50 arranged at right angles to the flange 48 and parallel to the plate-like portion 46.

A recess 52 in the form of a siphon-shaped half-duct is moulded in the plate-like portion 46.

The other insert 44 comprises a siphon-shaped semi-tubular appendage 54 extending from an upper flange 56 which is substantially a mirror image of the flange 48 and from which a lateral right-angled rim 58, which is a mirror image of the lateral rim 50 of the insert 42, extends.

When the two inserts 42, 44 are fitted together as will be explained further below, the recess 52 and the appendage 54 define a siphon-shaped duct which communicates with the inlet duct 32 at one end and opens into an upper chamber which will be referred to further below at the other end.

In order for the two inserts 42, 44 to be coupled securely, the recess 52 has re-entrant opposed edges 60 which define a fixing seat and the semi-tubular appendage has opposed lateral ribs 62 for fitting in this seat. Moreover, the plate-like portion 46 has a plurality of moulded pins 64 which engage in corresponding holes 66 moulded in lugs 68 which flank the semi-tubular appendage 54 of the insert 44.

Moreover, the edge of the flange 48 which faces the flange 56 has grooves 70 in which corresponding ribs 72 of the adjacent edge of the flange 56 of the insert 44 fit.

As already mentioned in the introductory part of the present description, in order to assemble the silencer, the first step consists of fitting the two inserts 42, 44 together by coupling their mutual fixing elements 60-62, 64-66 and 70-72.

This produces a two-part insert having a T-shaped configuration in which the plate-shaped portion 46 of the insert 42 constitutes a longitudinal partition corresponding to the leg of the T and in which the two flanges 48, 56 together form a transverse partition corresponding to the transverse portion of the T.

In order for the two inserts 42, 44 to be positioned firmly in the lower portion 28 of the silencer body, the peripheral wall of this lower portion 28 has internal longitudinal ribs which define grooves 74 for the insertion of the periphery of the partition.

The siphon-shaped appendage 54 has a lower tab 76 which is also fitted in a groove portion 74 situated in the base of the lower portion 28 of the body.

Towards its top, the lower portion 28 has shoulders 78 for the peripheral support of the two flanges 48, 56.

When the two inserts 42, 44 have been thus positioned, their turned-up portions 50, 58 project upwardly from the mouth of the lower portion 28 for the purpose which will be explained further below.

The assembly of the silencer is completed by the fitting of the lid 30 on the mouth of the lower portion 28.

The lid 30 is preferably snap-engaged on the lower portion 28, as shown. In particular, a peripheral skirt 80 of the lid 30, which fits precisely in the mouth of the lower element 28, has resilient tabs 82 which snap-engage in corresponding openings 84 in the upper portion of the element 28.

When the lid 30 is snap-engaged with the lower element 28, an upper wall 86 of the lid presses on the upper edges of the rims 50 58, ensuring once and for all both that the silencer body is closed and that the two inserts 42, 44 are held in position.

The partition 46 constituted by the plate-like portion of the insert 42 divides the cavity of the lower portion 28 of the body into two juxtaposed resonance chambers, indicated 88 and 90 in FIGS. 2 to 7.

These resonance chambers preferably have substantially identical volumes.

The resonance chamber 88 communicates with the interior of the siphon-shaped duct by means of a lateral hole or opening 92 formed in the appendage 54 towards the top thereof; the other resonance chamber 90 communicates with the interior of the duct by means of a lateral hole or opening 94 formed in the region of the bend in the recess 52.

The two resonance chambers 88, 90 are defined at the top by the transverse partition constituted by the two flanges 48, 50 in which the siphon-shaped duct opens.

An upper outlet or "plenum" chamber 96 from which the duct of the appendage 34 extends is defined between the upper wall 86 of the lid 30 and the transverse partition 48-56.

As is usual, the base wall of the lower element 28 has holes 98 for the drainage of oil from the resonance chambers 88, 90.

It has been found that, when an intake silencer according to the invention is fitted on compressors within the range having a power of from 40 to 170 watts and a displacement of from 3 to 15 cc, for given dimensions, a gain in efficiency of the order of 2% is achieved in comparison with the silencer according to the closest prior art.

This gain is thought to be due, on the one hand, to less pressure loss in the siphon-shaped duct and, on the other hand, to a reduction in the temperature of the gas drawn in. This would be due to the fact that the two resonance chambers 88, 90 behave as two impedances in parallel.

The temperature reduction appears to be due to the fact that, in a silencer according to the invention, the gas stalls in the silencer both less than in the silencer according to the closest prior art, and less in comparison with more conventional silencers, so that it receives less heat from the stator-plate assembly 18 (FIG. 1) of the electric motor.

What is claimed is:

1. An intake silencer for sealed motor-driven compressors for refrigerators and the like, comprising:

a hollow body constituted by a lower element (28) in the form of a cup and by an upper element (30) in the form of a lid, of which the lower element (28) comprises a lateral inlet duct (32) and the upper element (30) comprises an upper outlet duct (34), two partition walls (46, 48-56) inside the cavity of the body dividing this cavity into two resonance chambers (88, 90) and an upper outlet chamber (96) communicating with the outlet duct (34), and an internal duct (52-54) which has a siphon-like shape and the ends of which communicate with the inlet duct (32) and with the outlet chamber (96), respectively, the internal duct having, along its extent, lateral openings (92, 94) for communication with the two resonance chambers (88, 90), characterized in that it comprises a pair of matching inserts (42, 44) of rigid moulded plastics material which are confined inside the lower element (28) of the body by the lid (30) and which together have a T-shaped configuration with a Longitudinal partition (46) which corresponds to the leg of the T and which extends in the lower element (28) dividing it into two juxtaposed resonance chambers (88-90), and with a transverse partition (48-56) corresponding to the transverse portion of the T, which separates the juxtaposed resonance chambers (88, 90) from the upper outlet chamber (96), and in that each insert (42, 44) comprises a respective upper flange (48, 56) corresponding to a respective half of the transverse partition, one (42) of the inserts comprising the longitudinal partition (46) and this longitudinal partition having a siphon-shaped half-duct (52) in the form of a recess, and the other insert (44) comprising at least one semi-tubular appendage (54) of corresponding siphon-like shape extending from the respective upper flange (56) and constituting another half-duct which, in combination with the aforesaid recess (52), completes the internal duct.

2. An intake silencer according to claim 1, characterized in that one (52) of the half-ducts has a lateral opening (94) for communication with one (90) of the resonance chambers in a region corresponding to the bend in the siphon and the other (54) of the half-ducts has a lateral opening (92) for communication with the other resonance chamber (88) in a region between the bend in the siphon and the transverse partition (48-56).

3. An intake silencer according to claim 2, characterized in that the longitudinal partition (46) divides the cavity of the lower portion (28) of the body into two resonance chambers (88, 90) of substantially identical volume.

4. An intake silencer according to claim 1, characterized in that the lower element (28) of the body has internal shoulder surfaces (78) which face towards the upper element (30) and on which the upper flanges (48, 56) of the inserts (42, 44) bear, and in that the upper flange (48, 56) of each insert (42, 44) has, adjacent its end remote from the leg of the T, a respective right-angled rim (50, 58) which is directed towards the upper element (30) and against which the upper element reacts in order to keep the flange (48, 56) bearing against the shoulder surfaces (78).

5. An intake silencer according to claim 1, characterized in that the two inserts (42, 44) have mutual fixing elements (60, 62, 64, 66, 70, 72).

6. An intake silencer according to claim 5, characterized in that the mutual fixing elements comprise opposed re-entrant edges (60) which flank the recess (52) of the longitudinal partition (46), and in that the semi-tubular appendage (54) has opposed lateral ribs (62) for fitting in this seat.

7. An intake silencer according to claim 5, characterized in that, by way of mutual fixing elements, one insert (42) has a plurality of pins (64) and the other insert (44) has corresponding holes (66) for the engagement of the pins.

8. An intake silencer according to claim 5, characterized in that the mutual fixing elements comprise grooves (70) and corresponding ribs (72) formed on adjacent edges of the flanges (48, 56).

9. An intake silencer according to claim 1, characterized in that the tubular appendage has at least one tab (76) fitting against the longitudinal partition (46) and situated in the region of a wall of the lower element (28) of the body, and in that the peripheral wall has internal ribs which define fixing grooves (74) in which the periphery of the partition (46) and the tab (76) are fitted as a result of the introduction of the inserts (42, 44) into the lower element (28) of the body before the fitting of the upper element (30).

10. An intake silencer according to claim 1, characterized on that the upper element (30) of the body comprises a peripheral skirt (80) which is fitted in an upper portion of the lower element (28), the skirt (80) and the upper portion have snap-engagement elements (82, 84).

* * * * *